US009370932B2

(12) United States Patent
Fong et al.

(10) Patent No.: US 9,370,932 B2
(45) Date of Patent: Jun. 21, 2016

(54) SYSTEMS AND METHODS FOR STORING PRINTER CARTRIDGES

(75) Inventors: Wai Kong Fong, Singapore (SG); Surendran Ramachanthiran, Singapore (SG)

(73) Assignee: DELL PRODUCTS L.P., Round Rock, TX (US)

( * ) Notice: Subject to any disclaimer, the term of this patent is extended or adjusted under 35 U.S.C. 154(b) by 1797 days.

(21) Appl. No.: 12/208,892

(22) Filed: Sep. 11, 2008

(65) Prior Publication Data

US 2010/0060700 A1 Mar. 11, 2010

(51) Int. Cl.
*B41J 2/175* (2006.01)
*B41J 29/13* (2006.01)

(52) U.S. Cl.
CPC ..... *B41J 2/1752* (2013.01); *B41J 29/13* (2013.01); *B41J 2/17543* (2013.01)

(58) Field of Classification Search
CPC .. B41J 2/17509; B41J 2/17513; B41J 2/1752; B41J 2/175; B41J 2/16508; B41J 2/17543; B41J 29/13
USPC ..... 347/7, 19, 40, 42, 43, 47–49, 59, 347/67–69, 75, 84–87
See application file for complete search history.

(56) References Cited

U.S. PATENT DOCUMENTS

| | | | | |
|---|---|---|---|---|
| 5,926,196 | A | 7/1999 | Sawicki et al. | 347/108 |
| 6,062,683 | A * | 5/2000 | Kawakami et al. | 347/87 |
| 6,247,598 | B1 | 6/2001 | Hosaka et al. | 206/723 |
| 6,612,681 | B2 * | 9/2003 | Hasegawa et al. | 347/22 |
| 7,393,079 | B2 | 7/2008 | Ahne et al. | 347/22 |
| 7,396,116 | B2 * | 7/2008 | Yazawa | 347/86 |

* cited by examiner

*Primary Examiner* — Thinh Nguyen
(74) *Attorney, Agent, or Firm* — Baker Botts L.L.P.

(57) ABSTRACT

A printer may include a printer housing, a service station in the printer housing, an automated carriage assembly, and a print cartridge storage compartment. The service station defines an area for servicing one or more print cartridges. The automated carriage assembly is configured to carry the particular print cartridge through a printing area during a printing operation of the printer, and to carry the particular print cartridge to the service station area for servicing. The print cartridge storage compartment is defined by the printer housing and configured to store a spare print cartridge, the print cartridge storage compartment being separate from the service station and inaccessible to the carriage assembly.

17 Claims, 6 Drawing Sheets

SYSTEMS AND METHODS FOR STORING PRINTER CARTRIDGES

TECHNICAL FIELD

The present disclosure relates in general to printers, and more particularly to storage of print cartridges for printers.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

A printer may be used in connection with an information handling system, for example, for printing or writing data from the information handling system to some medium. A printer may be, may include, or may be a part of, an information handling system. Some printers include one or more print cartridges, for example, an ink cartridge for printing ink to paper. Some cartridge include a print head, while others do not. Example cartridges include black ink cartridges and photo ink cartridges. Some printers may only use one cartridge with a print head at a time, for example, either using a black ink cartridge or a photo ink cartridge. Additional packaging parts, such as a container with a lid, are typically needed to store additional cartridges. This may be costly and time consuming. In addition, a user may forget where a specific cartridge or additional packaging parts for storing the cartridge are located. In other words, packages for cartridges, the cartridges themselves, and/or cartridges in packages may be misplaced.

Care must be taken in swapping out printer cartridges, because cartridges removed from a printer may dry out. For example, ink drying on an outlet of a print head, such as for example the nozzles, may cause the printer to function improperly. In some cases, the pigments and dyes of the ink may dry out and form a solid block of hardened mass that plugs microscopic ink passageways, rendering the print head useless.

SUMMARY

In accordance with one embodiment of the present disclosure, a printer includes a printer housing, a service station in the printer housing, an automated carriage assembly, and a print cartridge storage compartment. The service station defines an area for servicing one or more print cartridges. The automated carriage assembly is configured to automatically carry the particular print cartridge through a printing area during a printing operation of the printer, and to carry the particular print cartridge to the service station area for servicing. The print cartridge storage compartment is defined by the printer housing and configured to store a spare print cartridge, the print cartridge storage compartment being separate from the service station and inaccessible to the carriage assembly.

In accordance with another embodiment of the present disclosure, a method is provided. A printer including a printer housing, a service station located in the printer housing and defining an area for servicing one or more print cartridges, and a carriage assembly for carrying a print cartridge is operated. During operation of the printer, the carriage assembly automatically carries a particular print cartridge through a printing area during a printing operation and to the service station for servicing. A spare print cartridge is stored in a print cartridge storage compartment at least partially defined in the printer housing and configured for storing the spare print cartridge, the print cartridge storage compartment being separate from the service station and inaccessible to the carriage assembly. The spare print cartridge is manually transferred from the print cartridge storage compartment to the carriage assembly such that the carriage assembly may use the spare print cartridge for printing.

In accordance with another embodiment of the present disclosure, a capping system for capping a print cartridge for use in a printer includes a capping seal and a biasing member. The capping seal is configured to seal a print head of a spare print cartridge stored in a print cartridge storage compartment formed in a housing of a printer. The biasing member is configured to bias the capping seal against the print head of the spare print cartridge stored in the print cartridge storage compartment. The capping system is located in the print cartridge storage compartment, the print cartridge storage compartment being separate from a service station area for servicing one or more print cartridges delivered by an automated movable print cartridge carriage assembly.

Certain embodiments of the present disclosure may include any one or some advantages discussed herein. For example, some embodiments may reduce the need for additional packaging parts for storing spare printer cartridges. Such embodiments may reduce costs and time for swapping cartridges.

Some embodiments may include a print head capping system to reduce the likelihood of a print head of a printer cartridge drying out. Such embodiments may reduce ink printing problems relating to ink drying on an outlet of a print head, e.g., the nozzles. Further, such embodiments may increase the ability of certain cartridges to be reused after periods of non-use.

Other technical advantages of the present disclosure will be readily apparent to one skilled in the art from the following description and claims. Various embodiments of the present application obtain only a subset of the advantages set forth. No one advantage is critical to the embodiments. Any claimed embodiment may be technically combined with any preceding claimed embodiment(s).

BRIEF DESCRIPTION OF THE DRAWINGS

A more complete understanding of the present embodiments and advantages thereof may be acquired by referring, by way of example, to the following description taken in conjunction with the accompanying drawings, in which like reference numbers indicate like features, and wherein.

DETAILED DESCRIPTION

Figure 1:
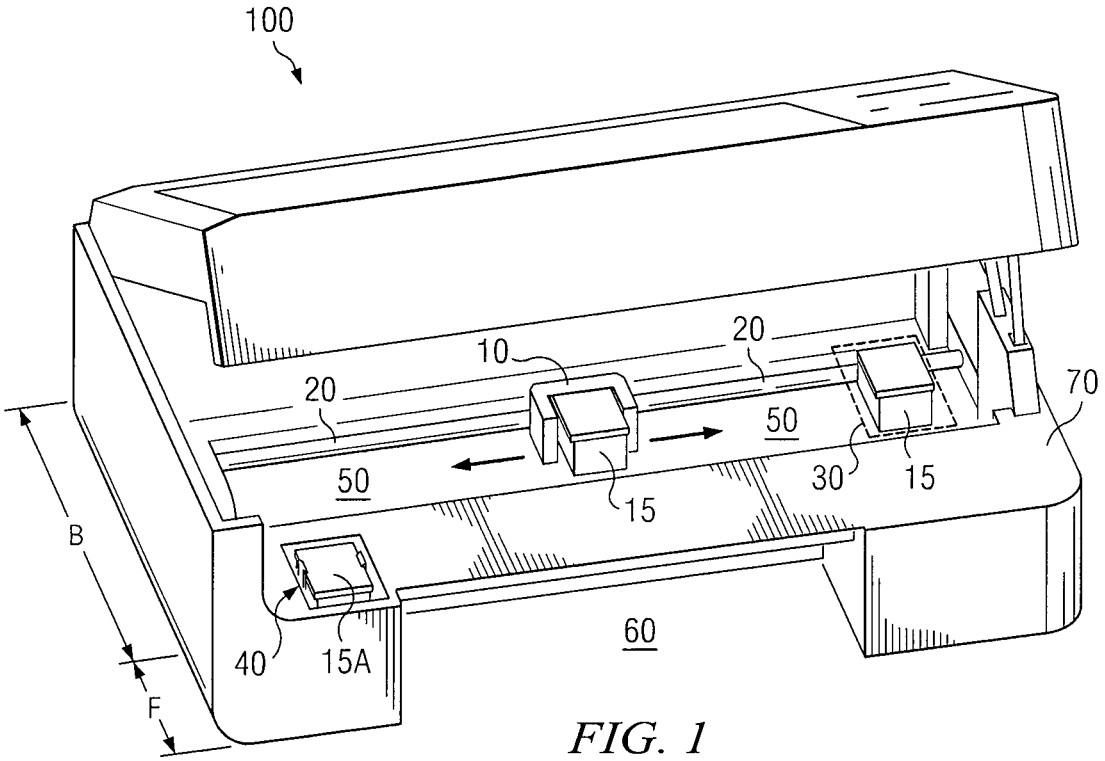
FIGS. 1-5 illustrate various views of an example printer including a spare cartridge storage compartment for one or more spare print cartridges, in accordance with certain embodiments of the present disclosure.

Preferred embodiments and their advantages are best understood by reference to FIGS. 1 to 9, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, a video display, and a printer, for example. The information handling system may also include one or more buses operable to transmit communication between the various hardware components. A printer may be used in connection with an information handling system, for example for printing information from the information handling system. A printer may comprise, or may be a part of, an information handling system.

As used herein, the term "printer" refers to any device, system or apparatus, used alone and/or in combination with one or more information handling systems to print images (e.g., text and/or pictures) on a recording medium (e.g., paper, transparencies, and/or any other suitable medium) using an imaging medium (e.g., toner, ink, and/or other suitable medium). As two examples only, printers may include toner-based imaging devices and inkjet imaging devices.

The imaging medium (e.g., toner, ink, and/or other suitable medium) for use in a printer may be housed in print cartridges that may be used by the printer. Typically, print cartridges may be swapped in and out of a printer as desired. As used herein, the term "cartridge" or "print cartridge" refers to any removable and/or replaceable component that houses any type of imaging medium (e.g., toner, ink, and/or other suitable medium) for use in a printer. A container may or may not also include one or more print heads. For example, a cartridge may include a container for image medium (e.g., an ink container) and/or a print head, e.g., for use in an ink printer or an ink jet printer. When such a cartridge is exhausted or replaced, the whole cartridge, including the container and the print head, may be removed and replaced with a new cartridge including a new print head. Alternatively, only one or more parts or components of the replaceable cartridge (e.g., the imaging medium container), may be replaced such that one or more other parts or components of the replaceable cartridge (e.g., a print head) may continue to be used.

In some embodiments, more than one cartridge or print head can be combined as treated as a single cartridge. A cartridge may contain one or more partitioned ink reservoirs. In some embodiments, a cartridge (e.g., the print head portion of a cartridge) may include electronic contacts and/or a chip for communicating with a printer or information handling system.

A print head may comprise one or more outlets for ink. An outlet may include one or more nozzles that allow ink to be delivered from an ink cartridge to a medium, e.g., paper.

Figure 2:
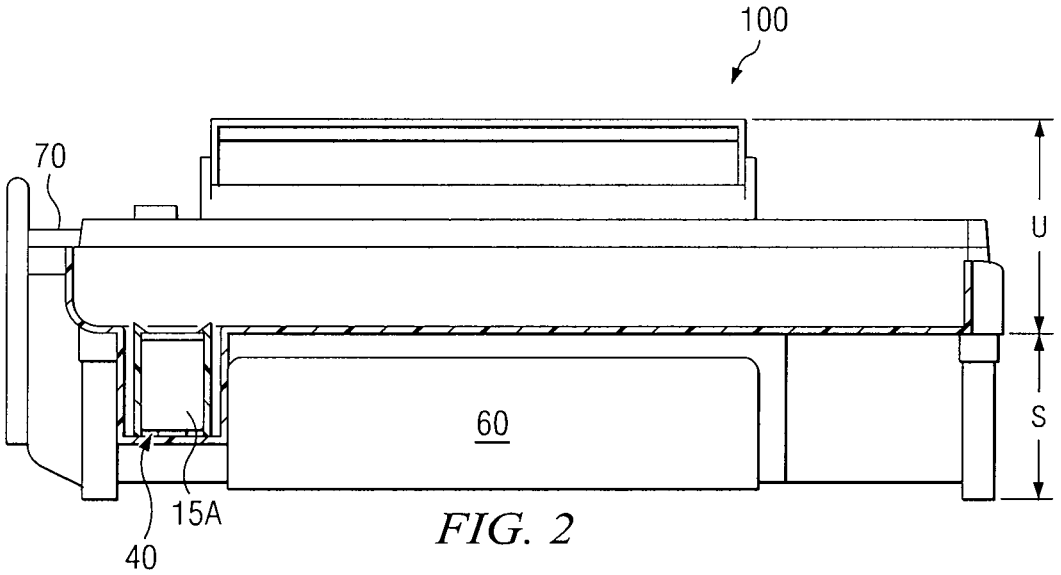
Figure 3:
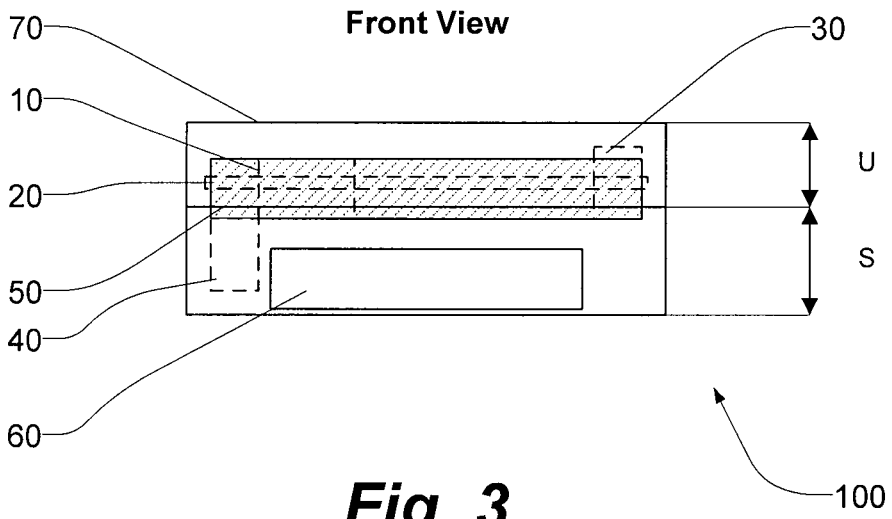
Figure 4:
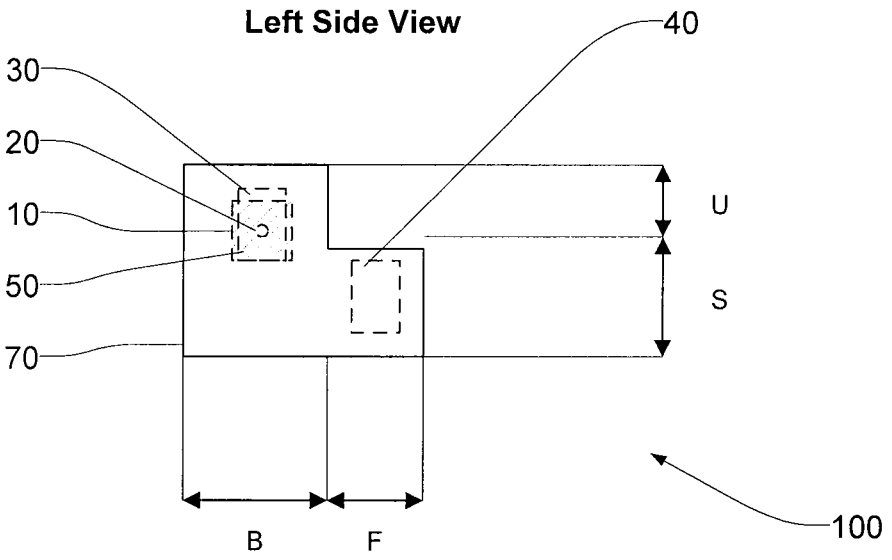
Figure 5:
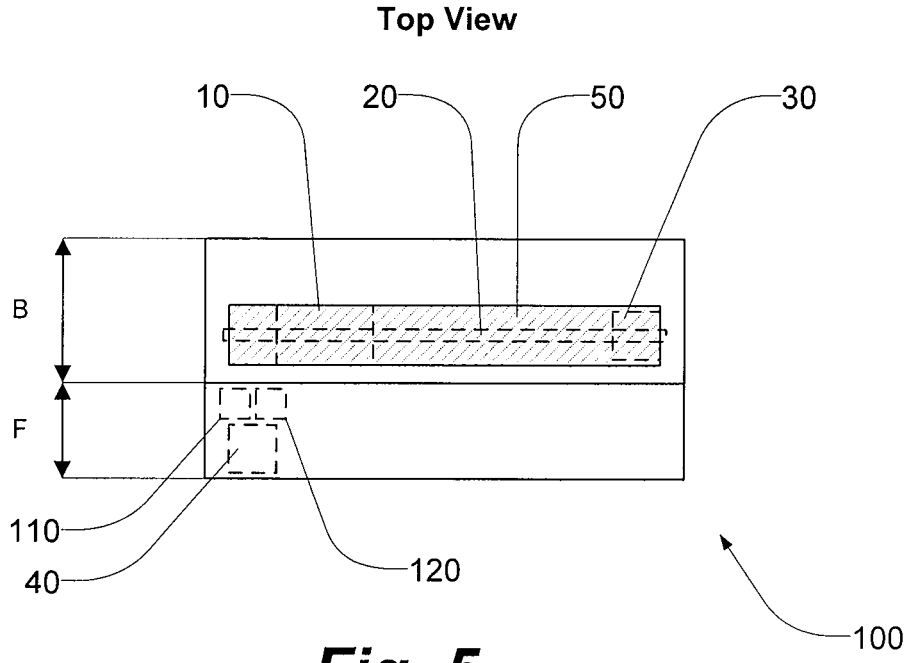

FIGS. 1-5 illustrate an example printer 100 including a storage compartment for one or more spare print cartridges, in accordance with certain embodiments of the present disclosure. FIG. 1 shows a 3-dimensional view of printer 100, FIG. 2 shows a front view of printer 100, FIG. 3 illustrates a schematic representation of a front view of printer 100, FIG. 4 illustrates a schematic representation of a side view of printer 100, and FIG. 5 illustrates a schematic representation of a top view of printer 100. The printer 100 may be, for example, an ink jet printer.

Taken together, FIG. 1-5 illustrate the printer 100 including a housing 70, a carriage 20, a carriage assembly 10 traveling on carriage 20 for moveably carrying one or more print cartridges 15, a service station 30 for storing one or more cartridges 15 that may be grabbed by carriage assembly 10, an outlet 60 for a print medium, and a spare print cartridge storage compartment 40 for storing one or more spare print cartridges 15A.

The carriage assembly 10 travels on the carriage 20 and carries one or more cartridges 15, for example an ink cartridge. When the printer 100 is operating, e.g., printing, the carriage assembly 10 travels along the carriage 20 (as indicated by the arrows in FIG. 1) and allows the cartridge 15 to print on the medium. When the printer 100 is not operating, the carriage assembly 10 may travel to the service station 30 (e.g., a storage or maintenance station), where the cartridge 15 may be parked. A cartridge 15 on the carriage assembly 10 may be carried to the service station 30 when moved to a home position or when the printer is not printing.

The service station 30 may be configured to "service" one or more print cartridges 15 not currently undergoing a printing operation. Servicing a print cartridge 15 may include any one or more of the following: storing the print cartridge 15; cleaning, wiping, and/or moistening a print head of a print cartridge 15; sealing a print head or ink compartment of a print cartridge 15 (e.g., to prevent leaking or drying out of the ink); and/or any other storage or maintenance service for a print cartridge 15. The service station 30 may be at any location in the printer, e.g., one or both end positions of the carriage 20 (e.g., the left and/or right end sides of the carriage 20 as shown in FIGS. 1 and 3). In the example embodiment of printer 100 illustrated in FIG. 1, the service station 30 is located at the right end side of the carriage 20.

A carriage travel area 50 may be defined as the area through which the movable carriage assembly 10 may move, as the carriage assembly 10 moves between the two end side positions of the carriage 20. This carriage travel area 50 is indicated as the shaded area in FIG. 3.

An outlet 60 is defined as the area allowing a print medium, e.g., paper, to exit the printer 100. The medium may enter, pass through, and exit the printer 100 as generally known in the printing industry. The necessary area required for the medium to exit the printer 100 may influence the overall configuration of the printer and its components.

A spare cartridge storage compartment 40 for one or more spare cartridges 15A may be at least partially defined in the housing 70 of the printer 100. The spare cartridge storage compartment 40 is in addition to, and separate from, the service station 30. The spare cartridge storage compartment 40 may store one or more spare cartridges 15A (e.g., one or more photo ink cartridge) while the carriage assembly 10 carries one or more cartridge 15 currently in use (e.g., a black ink cartridge 15). The spare cartridge storage compartment 40 may be formed integral with the housing 70 or a separate storage compartment coupled to or arranged within the housing 70. A spare cartridge 15A stored in the spare cartridge storage compartment 40 may or may not protrude from the spare cartridge storage compartment 40.

Some printers may be conceptually divided into an upper portion and a lower portion. For example, as shown in FIGS. 2-4, printer 100 is conceptually divided into an upper portion "U" and a lower portion "S." The lower portion may also be referred to as the support base of the printer. Generally, the upper portion U is located towards the top of the printer and the lower portion S is located towards the bottom of the printer.

FIG. 4 illustrates a schematic representation of a side view of printer 100, as viewed from the left side. As stated above, the printer 100 includes the housing 70, the carriage assembly 10, the carriage 20, the service station 30, and the storage compartment 40. The carriage travel area 50, defined as the space through which the movable carriage assembly 10 may move, is illustrated as shaded in FIG. 4.

A printer may be divided into a front portion and a back portion or sections. For example, as shown in FIGS. 1 and 4, printer 100 has been divided into a front portion "F" and a back portion "B". Generally, the front portion F is located towards the front of the printer and the back portion B is located towards the rear of the printer.

FIG. 5 illustrates a schematic representation of a top view of the printer 100. As stated above, the printer 100 includes the housing 70, the carriage assembly 10, the carriage 20, the service station 30, and the storage compartment 40. The carriage travel area 50, defined as the space the movable carriage assembly 10 may move, is again indicated with shading.

The spare cartridge storage compartment 40 may be situated in any location within the housing 70 of the printer 100 that does not interfere with the carriage travel area 50. Preferably, the location of the spare cartridge storage compartment 40 additionally does not interfere with the outlet 60. In some embodiments, the spare cartridge storage compartment 40 may be located in the support base S, which may allow a user to access the spare cartridge storage compartment 40 from an upper surface of the support base S. In some embodiments, the spare cartridge storage compartment 40 may be located towards the front portion F. In addition, the spare cartridge storage compartment 40 may be located to the left or right of the outlet 60. Such a location may reduce or eliminate the interference of the spare cartridge storage compartment 40 with other components of the printer 100. In addition, the spare cartridge storage compartment 40 may include enough space for a capping seal system for sealing a print head of at least one spare cartridge 15A.

In some embodiments, the spare cartridge storage compartment 40 may be adapted to store one or more spare cartridges 15A in a vertical or upright orientation, which may help keep the ink or other imaging medium in the desired position within the cartridge 15A when the cartridge 15A is taken out of the storage compartment, e.g., to be inserted into the carriage assembly 10 (or in some embodiments, into the service station 30).

In some embodiments, the printer 100 may include a spare print cartridge identification system 110 (see FIG. 3) configured to detect various information from spare cartridges 15A (e.g., from a print head of a stored cartridge 15A) stored in storage compartment 40. This may allow a printer 100 to determine and/or communicate to a user data such as, e.g., whether a cartridge 15A is stored in the storage compartment, how many cartridges 15A are stored in the storage compartment, which type(s) or cartridge(s) 15A is/are stored in the storage compartment 40, how long each cartridge 15A has been stored or used, etc. Furthermore, an information handling system connected to the printer may use the information collected from each spare cartridge 15A.

In some embodiments, the printer 100 may include a cleaning/moistening system 120 (see FIG. 3) adapted to clean, or to moisten, or both, a print head of at least one stored spare cartridge 15A. This may reduce drying out of nozzles within the print head and/or reduce clogged nozzles, which may improve the printing quality.

Figure 6:
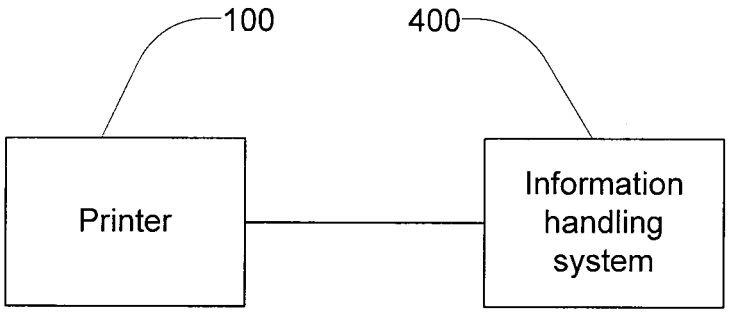
FIG. 6 illustrates an information handling system coupled to a printer, according to certain embodiments of the present disclosure.

As illustrated in FIG. 6, in some embodiments, an information handling system 400 may include a printer 100 including a storage compartment 40 for at least one spare cartridge 15A. The information handling system 400 may be a part of the printer 100, externally connected to the printer 100 (e.g., via a network), or the printer 100 may be a part of the information handling system 400. As discussed above, in some embodiments, the spare cartridge storage compartment 40 may be adapted to detect information of one or more stored spare cartridge(s) 15A or a print head for such spare cartridge (s) 15A and communicate such information to the information handling system 400. Additionally, the information handling system 400 may be adapted to clean and/or moisten a print head of the stored cartridge(s) 15 in the storage compartment.

Figure 7:
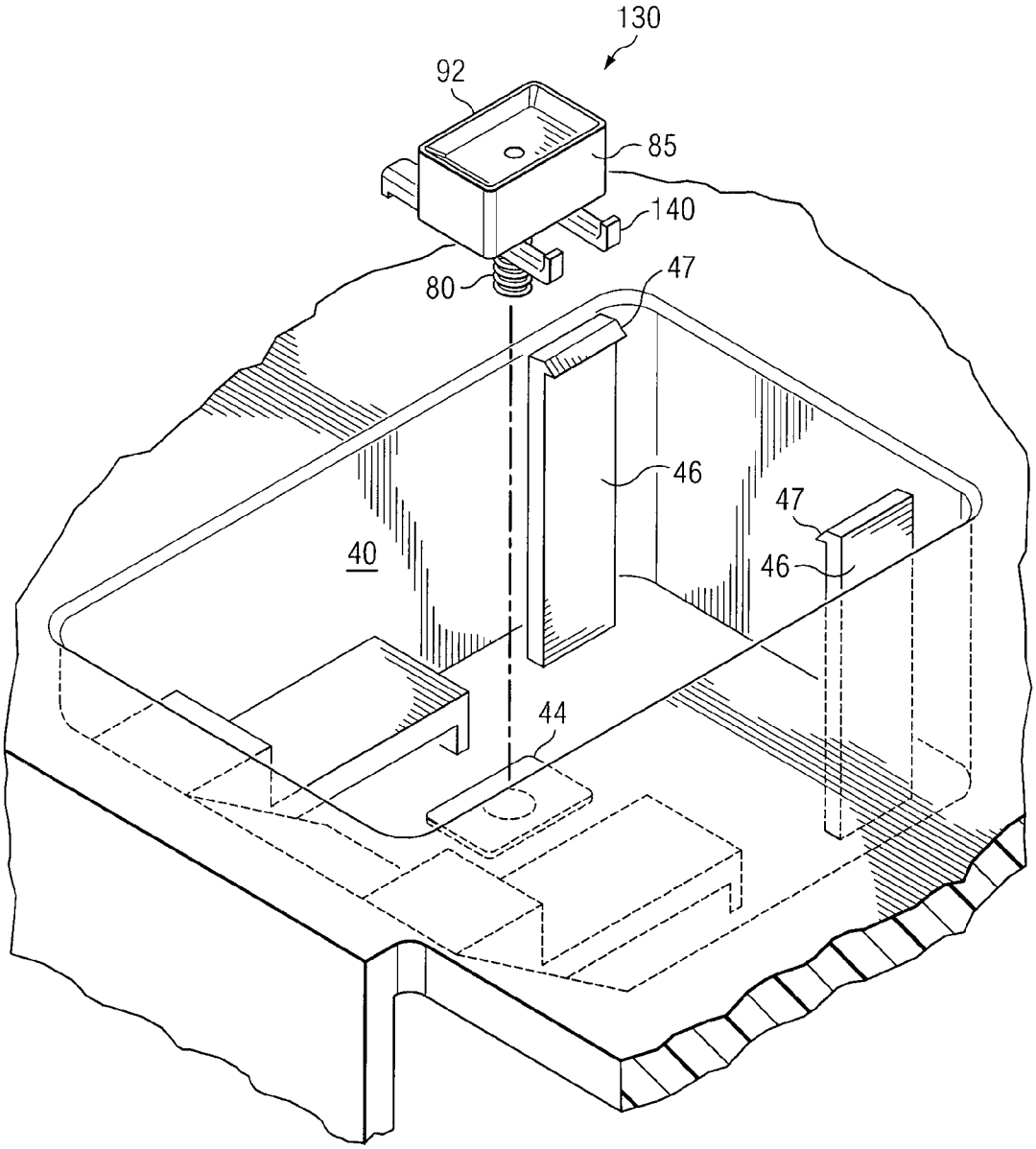
FIG. 7-9 illustrate various views of a spare cartridge storage compartment including a capping system for forming a seal with a print head of a spare cartridge stored in the spare cartridge storage compartment, in accordance with certain embodiments of the present disclosure.
Figure 8:
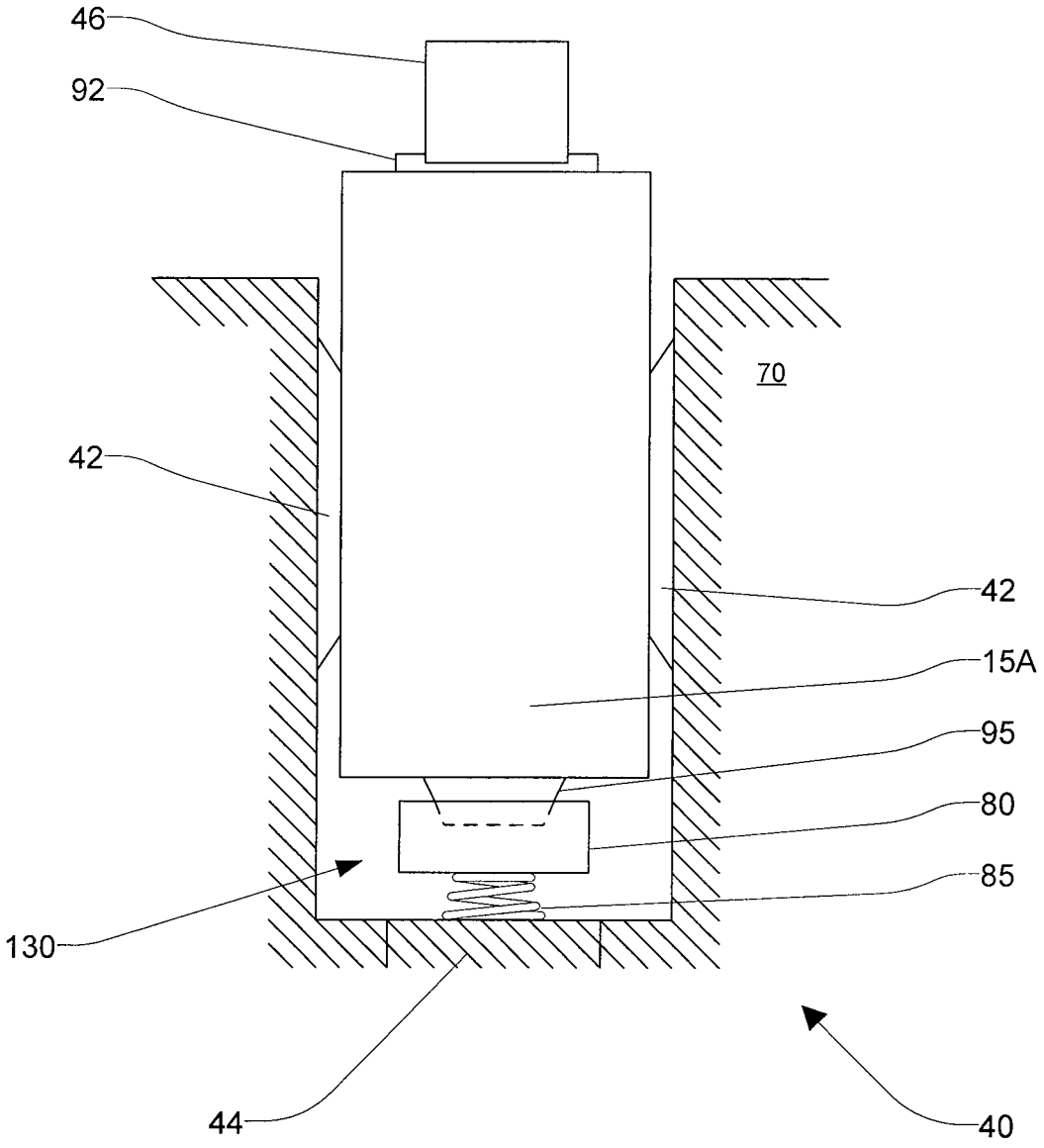
Figure 9:
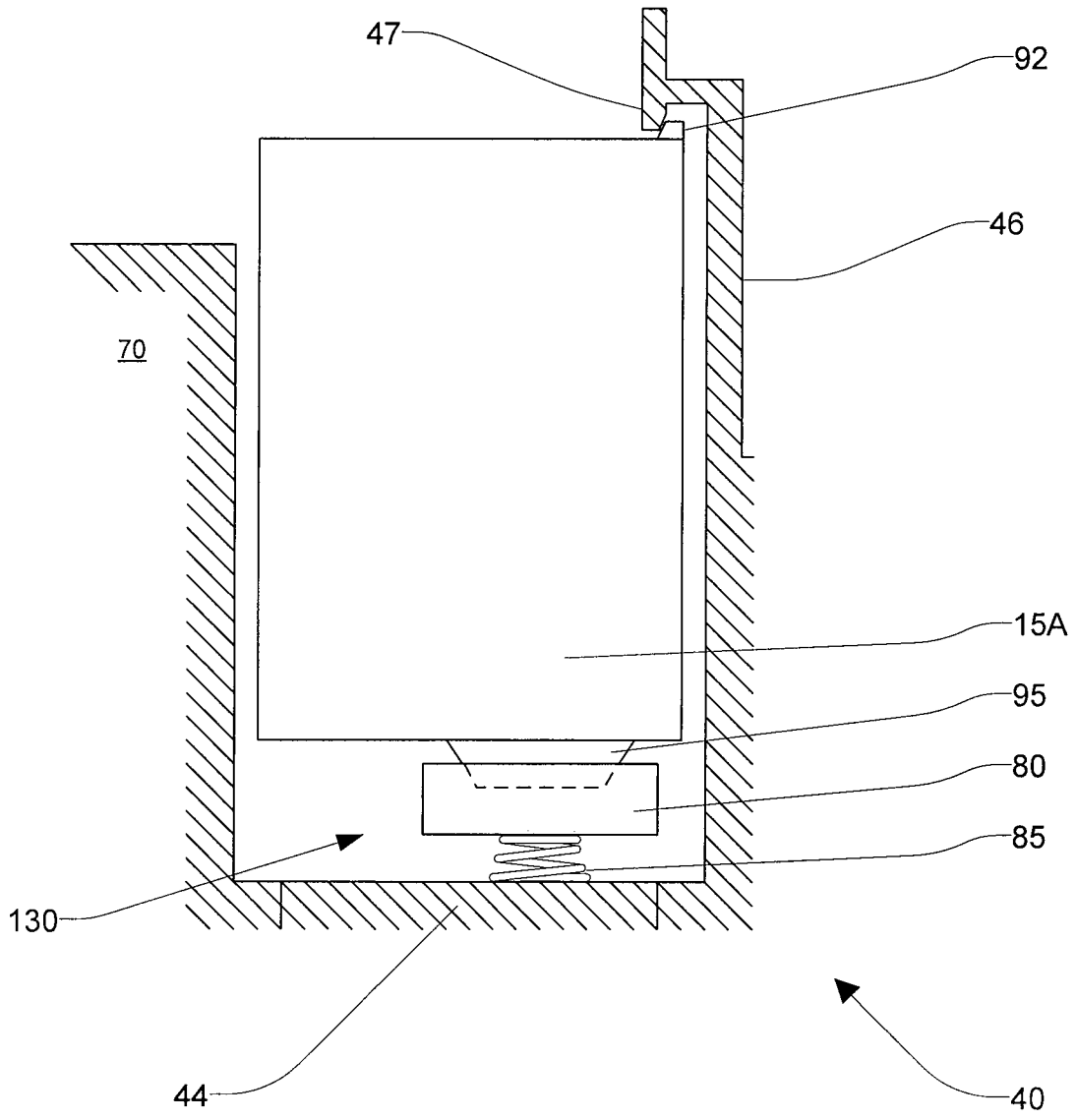

In some embodiments, the spare cartridge storage compartment 40 may include a capping system 130 for capping a print head or other similar component of a stored print cartridge 15A, e.g., to prevent a stored cartridge 15A from drying out. FIGS. 7-9 illustrate an example embodiment of a spare cartridge storage compartment 40 including a capping system 130 for capping a print head of a single cartridge 15A. Capping system 130 may include a capping seal 80, a biasing member 85, a securing element 46, a removable bottom portion 44, and at least one cartridge supporting element 42.

The capping seal 80 may be biased against the stored cartridge 15A by a biasing member 85. Biasing member 85 may comprise a flexible member or any other device or material configured to provide a biasing force. For example, in the example shown in FIGS. 5 and 6, biasing member 85 comprises a spring. As another example, a flexible protrusion, such as a tongue, extending from a part of the spare cartridge storage compartment 40 or the removable bottom portion 44, may be used. Other examples include a foam material or an extended flexible part of the capping seal itself. The biasing member 85 biases or urges the capping seal 80 towards and against a print head 95 of the spare cartridge 15A in the storage compartment 40, which may help prevent nozzles of the print head 95 from drying out.

The spare cartridge storage compartment 40 may include one or more securing elements 46 for engaging the cartridge 15A and for counteracting the flexibly held capping seal 80. The securing element 46 may engage the cartridge 15A on an opposite side as the capping seal 80, for example the top side of cartridge 15A, to counteract the force applied to the bottom of cartridge 15A by the biasing member 85 and to secure the cartridge 15A in the storage compartment 40. The securing element 46 may have any suitable shape for engaging the cartridge 15A. In the embodiment shown in FIGS. 7-9, each securing element 46 is a flexible arm connected to housing 70 at one end and having a hooked catch portion 47 at the free end, the hooked catch portion 47 configured to mate with a surface or edge of cartridge 15A, e.g., a lip portion 92 of the cartridge 15A shown in FIGS. 7-9.

To secure a cartridge 15A in the spare cartridge storage compartment 40, a user may align the cartridge 15A vertically and press the cartridge 15A downward until the hooked catch portion 47 of the securing elements 46 catch on the lip portion 92 of the cartridge 15A. As the bottom of the cartridge 15A is pressed down into the bottom the storage compartment 40, the print head 95 is received in the capping seal 80, which forms a seal with the print head 95.

To remove the cartridge 15A from the spare cartridge storage compartment 40, the user may flex the securing elements 46 outwardly to free cartridge 15A from the hooked catch portions 47. Biasing element 85 may then force the cartridge 15A upwardly such that user may remove the cartridge 15A from the storage compartment 40.

The biasing member 85 and the capping seal 80 may be supported by a part of the housing 70 and/or the storage compartment 40. In some embodiments, the biasing member 85 and the capping seal 80 may be supported by a removable bottom portion 44 of the spare cartridge storage compartment 40 shown in FIGS. 7-9. The removable bottom portion 44 may be, for example, hinged, snap fitted, screwed, and/or attached by other fastening means to the housing 70 and/or the storage compartment 40. Any bottom part removably secured to the housing 70 and/or the storage compartment 40, from below or above, and supporting the biasing member 85 and the capping seal 80 may be used.

The spare cartridge storage compartment 40 may include at least one cartridge supporting element 42 to guide, position and/or hold the cartridge 15A in a designated position within the storage compartment 40. FIG. 8 illustrates an example embodiment including two cartridge supporting element 42. In other embodiments, the spare cartridge storage compartment 40 may have four, five, six, seven, eight, or any other number of cartridge supporting element 42. For example, the spare cartridge storage compartment 40 may include two cartridge supporting element 42 on each longer side walls and one or two cartridge supporting element 42 on each shorter side walls. The bottom of the spare cartridge storage compartment 40 may also have at least one cartridge supporting element 42. The cartridge supporting elements 42 may improve the position of the print head 95 of the cartridge 15A within the spare cartridge storage compartment 40 and thus may also improve the sealing properties of the capping seal 80 sealing the print head 95. In some embodiments, the spare cartridge storage compartment 40 may be adapted to clamp at least one cartridge 15A.

In operation, a printer with a housing including a spare cartridge storage compartment may be used for storing one or more spare print cartridges in addition to any print cartridges in the carriage assembly and/or the service station of the printer. The spare cartridge storage compartment is preferably adapted to store at least one print cartridge in a vertical position and may include a capping seal for a print head of the at least one print cartridge. As an example, a user may wish to swap out a black ink cartridge used by the printer for a photo ink cartridge stored in the spare cartridge storage compartment. In such a case, the user may remove the black ink cartridge from the carriage assembly or from the service station. The user may remove the photo ink cartridge from the spare cartridge storage compartment and insert it in the carriage assembly (or, in some embodiments, into the service station for pick-up by the carriage assembly). The user may insert the black ink cartridge in the spare cartridge storage compartment for later use. It should be understood that this is only one example implementation.

Although the present disclosure has been described in detail, it should be understood that various changes, substitutions, and alterations can be made hereto without departing from the spirit and the scope of the disclosure as defined by the appended claims

What is claimed is:

1. A printer, comprising:

a printer housing;

a service station in the printer housing, the service station defining an area for servicing one or more print cartridges;

an automated carriage assembly configured to:

carry the particular print cartridge through a printing area during a printing operation of the printer; and carry the particular print cartridge to the service station area for servicing;

a print cartridge storage compartment defined by the printer housing and configured to store a spare print cartridge, the print cartridge storage compartment being separate from the service station and inaccessible to the carriage assembly at all times; and a spare print cartridge identification system configured to automatically identify at least one of:

whether a spare print cartridge is present in the print cartridge storage compartment; and identification data regarding a spare print cartridge stored in the print cartridge storage compartment.

2. A printer according to claim 1, wherein:

the print cartridge storage compartment is configured to align the spare print cartridge in a vertical orientation; and the print cartridge storage compartment includes a capping seal for sealing a print head of a spare print cartridge stored in the print cartridge storage compartment.

3. A printer according to claim 1, wherein:

the print cartridge storage compartment includes a capping seal for sealing a print head of a spare print cartridge stored in the print cartridge storage compartment; and the capping seal is biased against the print head of the spare print cartridge by a spring force.

4. A printer according to claim 3, wherein the print cartridge storage compartment includes a protrusion for engaging the spare print cartridge, the protrusion counteracting the spring force of the capping seal against the print head.

5. A printer according to claim 1, wherein the print cartridge storage compartment includes:

a capping seal for sealing a print head of a spare print cartridge stored in the print cartridge storage compartment; and a removable device that supports the capping seal, the removable device being removable from the print cartridge storage compartment.

6. A printer according to claim 1, wherein the print cartridge storage compartment is configured to clean or moisten a print head of a spare print cartridge stored in the print cartridge storage compartment.

7. A printer according to claim 1, wherein:

the printing area is generally located at an upper part of the printer housing; and the print cartridge storage compartment is generally located at a lower part of the printer housing.

8. A printer according to claim 1, further comprising a spare print cartridge stored in the print cartridge storage compartment.

9. A printer according to claim 1, wherein servicing one or more print cartridges in the service station area comprises at least one of:

storing a print cartridge; and cleaning a print head of a print cartridge.

10. A method, comprising:

operating a printer including a printer housing, a service station located in the printer housing and defining an area for servicing one or more print cartridges, and a carriage assembly for carrying a print cartridge;

wherein during operation of the printer, the carriage assembly automatically carries a particular print cartridge through a printing area during a printing operation and to the service station for servicing;

storing a spare print cartridge in a print cartridge storage compartment at least partially defined in the printer housing and configured for storing the spare print cartridge, the print cartridge storage compartment being separate from the service station and inaccessible to the carriage assembly at all times;

automatically identifying, by a spare print cartridge identification system associated with the print cartridge storage compartment, at least one of:

whether a spare print cartridge is present in the print cartridge storage compartment; and identification data regarding a spare print cartridge stored in the print cartridge storage compartment; and manually transferring the spare print cartridge from the print cartridge storage compartment to the carriage assembly such that the carriage assembly may use the spare print cartridge for printing.

11. A method according to claim 10, wherein, during storage of the spare print cartridge in the print cartridge storage compartment, a capping seal is biased against a print head of the spare print cartridge by a spring force.

12. A method according to claim 11, wherein, during storage of the spare print cartridge in the print cartridge storage compartment, a protrusion of the print cartridge storage compartment engages the spare print cartridge to counteract spring force of the capping seal against the print head.

13. A method according to claim 10, further comprising inserting a removable capping seal support device into the print cartridge storage compartment, the removable capping seal support device configured to support the capping seal.

14. A method according to claim 10, further comprising the print cartridge storage compartment automatically cleaning or moistening a print head of the spare print cartridge stored in the print cartridge storage compartment.

15. A capping system for capping a print cartridge for use in a printer, the capping system comprising:

a capping seal configured to seal a print head of a spare print cartridge stored in a print cartridge storage compartment formed in a housing of a printer, the print cartridge storage compartment being inaccessible to a carriage assembly at all times; and a biasing member configured to bias the capping seal against the print head of the spare print cartridge stored in the print cartridge storage compartment;

wherein the capping system is located in the print cartridge storage compartment and removable from the print cartridge storage compartment, the print cartridge storage compartment being separate from a service station area for servicing one or more print cartridges delivered by an automated movable print cartridge carriage assembly.

16. A print cartridge capping system according to claim 15, wherein the biasing member comprises a spring.

17. A print cartridge capping system according to claim 15, further comprising a protrusion configured to engage a spare print cartridge stored in the print cartridge storage compartment, the protrusion counteracting the spring force of the capping seal against the print head of the spare print cartridge.

* * * * *